US007661221B2

(12) United States Patent
Holmberg

(10) Patent No.: US 7,661,221 B2
(45) **Date of Patent: *Feb. 16, 2010**

(54) DEVICE MOUNT

(76) Inventor: Larry Holmberg, P.O. Box 63, Wascott, WI (US) 54890

( * ) Notice: Subject to any disclaimer, the term of this patent is extended or adjusted under 35 U.S.C. 154(b) by 366 days.

This patent is subject to a terminal disclaimer.

(21) Appl. No.: 11/480,029

(22) Filed: Jun. 30, 2006

(65) Prior Publication Data

US 2007/0157503 A1 Jul. 12, 2007

Related U.S. Application Data

(63) Continuation-in-part of application No. 11/327,123, filed on Jan. 6, 2006, now Pat. No. 7,574,824.

(51) Int. Cl.
*F41C 27/00* (2006.01)

(52) U.S. Cl. ..... 42/106; 42/124; 396/419

(58) Field of Classification Search ..... 42/124, 42/125, 126, 127, 148; 89/41.05; 396/419
See application file for complete search history.

(56) References Cited

U.S. PATENT DOCUMENTS

| | | | |
|---|---|---|---|
| 2,101,479 | A | 12/1937 | Schenk |
| 3,427,102 | A | 2/1969 | Wade |
| 3,684,376 | A | 8/1972 | Lessard |
| 3,782,822 | A | 1/1974 | Spence |
| 3,834,052 | A | 9/1974 | Steck, III |
| T101,001 | I4 | 9/1981 | Shipp et al. |
| 4,296,725 | A | 10/1981 | Broderick |
| D268,910 | S | 5/1983 | Shipp et al. |
| 4,531,052 | A | 7/1985 | Moore |
| 4,617,741 | A | 10/1986 | Bordeaux et al. |
| 4,643,159 | A | 2/1987 | Ryan |
| 4,730,190 | A | 3/1988 | Win et al. |
| 4,753,528 | A | 6/1988 | Hines et al. |
| 4,777,352 | A | 10/1988 | Moore |
| 4,835,621 | A | 5/1989 | Black |
| 4,890,128 | A | 12/1989 | Kania |
| 4,910,717 | A | 3/1990 | Terry |
| 4,939,863 | A | 7/1990 | Alexander et al. |
| D313,361 | S | 1/1991 | Robinson |
| 4,993,833 | A | 2/1991 | Lorey et al. |
| 5,020,262 | A | 6/1991 | Pena |
| 5,026,158 | A | 6/1991 | Golubic |
| 5,373,657 | A | 12/1994 | Betz et al. |
| 5,479,712 | A | 1/1996 | Hargrove et al. |

(Continued)

FOREIGN PATENT DOCUMENTS

| | | |
|---|---|---|
| EP | 1804017 A1 | 7/2007 |

(Continued)

*Primary Examiner*—Michael Carone
*Assistant Examiner*—Benjamin P Lee
(74) *Attorney, Agent, or Firm*—Kinney & Lange, P.A.

(57) ABSTRACT

A device mount for a weapon is provided. The device mount includes a support portion and a side portion. The support portion is adapted to support a device. The support portion includes a plurality of mounting apertures. The side portion is coupled to the support portion. The side portion has a first side positioned generally at a right angle to the support portion. The side portion further has a second side. Moreover, the second side has a mounting connection portion adapted to connect the device mount to a weapon.

13 Claims, 2 Drawing Sheets

U.S. PATENT DOCUMENTS

| | | | | |
|---|---|---|---|---|
| D371,084 | S | 6/1996 | Ogawa | |
| 5,575,072 | A | 11/1996 | Eldridge | |
| 5,669,174 | A | 9/1997 | Teetzel | |
| D390,483 | S | 2/1998 | Zykan et al. | |
| 5,815,251 | A | 9/1998 | Ebbets et al. | |
| 5,859,693 | A | 1/1999 | Dunne et al. | |
| 5,887,375 | A | 3/1999 | Watson | |
| 5,926,260 | A | 7/1999 | Dunne et al. | |
| 5,937,562 | A | 8/1999 | Brough | |
| 5,949,529 | A | 9/1999 | Dunne et al. | |
| 5,973,315 | A | 10/1999 | Saldana et al. | |
| D421,229 | S | 2/2000 | Imai | |
| 6,070,355 | A | 6/2000 | Day | |
| 6,073,352 | A | 6/2000 | Zykan et al. | |
| D432,930 | S | 10/2000 | Sanoner | |
| 6,137,564 | A | 10/2000 | Schmidt et al. | |
| 6,154,971 | A | 12/2000 | Perkins | |
| 6,192,614 | B1 | 2/2001 | Cliburn | |
| 6,269,581 | B1 | 8/2001 | Groh | |
| D448,315 | S | 9/2001 | Ito | |
| 6,286,796 | B1 | 9/2001 | Pugliesi | |
| 6,331,887 | B1 | 12/2001 | Shiraishi et al. | |
| 6,336,285 | B1 * | 1/2002 | Baumer | 42/124 |
| 6,396,571 | B2 | 5/2002 | Ohtomo et al. | |
| 6,397,483 | B1 | 6/2002 | Perkins | |
| D460,367 | S | 7/2002 | Apothéloz et al. | |
| D460,368 | S | 7/2002 | Apothéloz et al. | |
| D460,369 | S | 7/2002 | Apothéloz et al. | |
| 6,425,697 | B1 | 7/2002 | Potts et al. | |
| 6,450,816 | B1 | 9/2002 | Gerber | |
| 6,526,956 | B1 | 3/2003 | Hankins | |
| D472,826 | S | 4/2003 | Sanoner | |
| 6,556,245 | B1 | 4/2003 | Holmberg | |
| 6,615,531 | B1 | 9/2003 | Holmberg | |
| 6,624,881 | B2 | 9/2003 | Waibel et al. | |
| 6,693,702 | B2 | 2/2004 | Rogers | |
| 6,704,097 | B2 | 3/2004 | Waibel et al. | |
| 6,722,076 | B2 | 4/2004 | Nielsen | |
| 6,742,299 | B2 | 6/2004 | Strand | |
| 6,796,038 | B2 | 9/2004 | Humphries | |
| 6,886,288 | B1 | 5/2005 | Yocum et al. | |
| 6,932,305 | B2 | 8/2005 | Morales et al. | |
| 6,988,331 | B2 | 1/2006 | Holmberg | |
| 7,006,144 | B2 | 2/2006 | Holmberg | |
| 7,128,354 | B2 | 10/2006 | Wu | |
| 7,269,920 | B2 | 9/2007 | Staley, III | |
| 2002/0067475 | A1 | 6/2002 | Waibel et al. | |
| 2003/0133092 | A1 | 7/2003 | Rogers | |
| 2003/0163943 | A1 | 9/2003 | Holmberg | |
| 2004/0051865 | A1 | 3/2004 | Stierle et al. | |
| 2004/0079018 | A1 | 4/2004 | Holmberg | |
| 2004/0114129 | A1 | 6/2004 | Gogolla et al. | |
| 2004/0135991 | A1 | 7/2004 | Gogolla et al. | |
| 2004/0183942 | A1 | 9/2004 | Holmberg | |
| 2004/0194364 | A1 | 10/2004 | Holmberg | |
| 2004/0257437 | A1 | 12/2004 | Lesseu | |
| 2005/0035245 | A1 | 2/2005 | Morales et al. | |
| 2005/0241210 | A1 | 11/2005 | Karcher et al. | |
| 2005/0252062 | A1 | 11/2005 | Scrogin et al. | |

FOREIGN PATENT DOCUMENTS

| | | | |
|---|---|---|---|
| GB | 2 024 558 | A | 1/1980 |
| GB | 2 114 770 | A | 8/1983 |
| WO | WO 90/12330 | | 10/1990 |
| WO | 2006090356 | A1 | 8/2006 |
| WO | 2006133029 | A2 | 12/2006 |

* cited by examiner

DEVICE MOUNT

CROSS REFERENCE TO RELATED CASE

This application claims priority to and is a Continuation In Part of U.S. patent application Ser. No. 11/327,123, with a title "DEVICE MOUNT FOR A FIREARM" filed on Jan. 6, 2006, which is incorporated herein by reference in its entirety.

BACKGROUND

For game hunters the ability to record the hunt in an efficient manner is desired. Moreover, the ability to attach other devices such as rangefinders and other electronic device to the weapon in a manner that does not impede the hunt is also desired. For the reasons stated above and for other reasons stated below which will become apparent to those skilled in the art upon reading and understanding the present specification, there is a need in the art for a mount that can attach a device such an electronic device to a weapon in an effective and un-intrusive manner.

SUMMARY OF INVENTION

The above-mentioned problems of current systems are addressed by embodiments of the present invention and will be understood by reading and studying the following specification. The following summaries are provided as way of examples and not by way of limitations. Moreover, the summaries may include more or less elements than are in the claims and merely provided to give the reader a basic understanding of some of the elements of the present invention.

In one embodiment, a device mount for a weapon is provided. The device mount includes a support portion and a side portion. The support portion is adapted to support a device. The support portion includes a plurality of mounting apertures. The side portion is coupled to the support portion. The side portion has a first side positioned generally at a right angle to the support portion. The side portion further has a second side. Moreover, the second side has a mounting connection portion adapted to connect the device mount to a weapon.

In another embodiment, another mount for a device is provided. The mount includes a side plate having a first end and a second end, a support plate and a mounting rail. The support plate extends from the first end of the side plate. The support plate is further adapted to support a device resting thereon. Moreover, the support plate has a plurality of mounting apertures passing there through. The mounting rail is coupled to the second end of the side plate. The mounting rail extends out from the side plate in a direction that is approximately opposite the direction the support plate extends from the side plate.

In still another embodiment, a mounting system for a weapon is provided. The system includes a device mount having support plate adapted to support a device resting thereon. The support plate has at least one mounting aperture and a mounting rail. The mounting system further includes a scope mount ring that is adapted to couple the mounting rail to a weapon.

In yet another embodiment, a method of attaching a device to a weapon is provided. The method includes positioning the device on a support plate of the device mount. Aligning an internally threaded bore in the device with one of a plurality of mounting apertures passing through the support plate. Threadably engaging the internally threaded bore through the one mounting aperture. Coupling the device mount to a scope mount ring and coupling the scope mount to a weapon.

BRIEF DESCRIPTION OF THE DRAWINGS

The present invention can be more easily understood and further advantages and uses thereof more readily apparent, when considered in view of the description of the preferred embodiments and the following figures in which.

In accordance with common practice, the various described features are not drawn to scale but are drawn to emphasize specific features relevant to the present invention. Reference characters denote like elements throughout Figures and text.

DETAILED DESCRIPTION

In the following detailed description, reference is made to the accompanying drawings, which form a part hereof, and in which is shown by way of illustration specific embodiments in which the inventions may be practiced. These embodiments are described in sufficient detail to enable those skilled in the art to practice the invention, and it is to be understood that other embodiments may be utilized and that logical, mechanical and electrical changes may be made without departing from the spirit and scope of the present invention. The following detailed description is, therefore, not to be taken in a limiting sense, and the scope of the present invention is defined only by the claims and equivalents thereof.

Embodiments of the present invention provide a mount that allows for the attachment of a device such as a video camera, rangefinder, game caller or the like, to a weapon. In particular, in one embodiment, the mount allows the device to be mounted to a scope of a weapon in a manner that does not hamper the operation of the scope (i.e. the elevation and/or windage adjustment knob for example) or other operations of the weapon.

Figure 1:
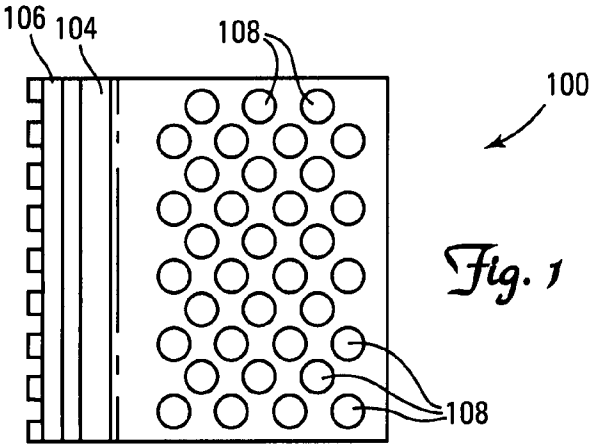
FIG. 1 is a top view of one embodiment of a device mount of one embodiment of the present invention.
Figure 2:
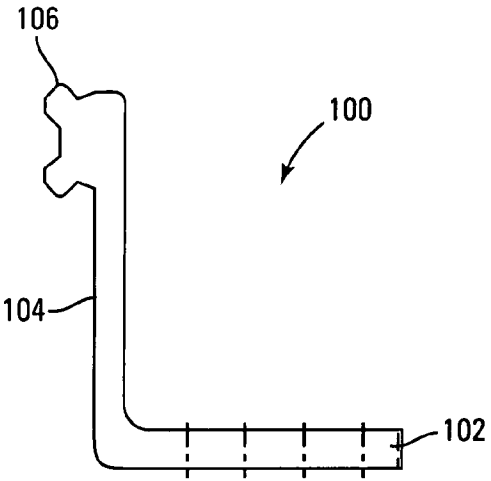
FIG. 2 is a front view of the device mount of FIG. 1.
Figure 3:
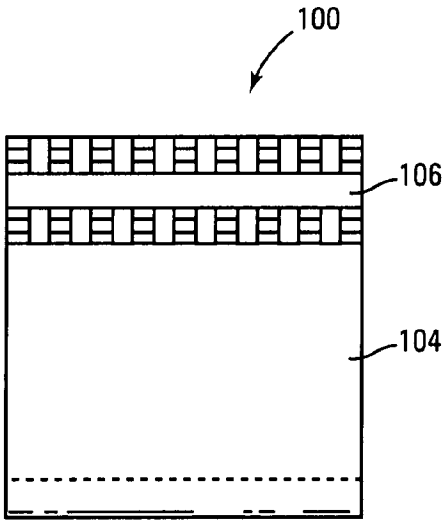
FIG. 3 is a side view of the device mount of FIG. 1.

Referring to FIGS. 1, 2 and 3, a top view, front view and a side view respectively of one embodiment of a device mount 100 is provided. As illustrated, the device mount 100 includes a support plate (or support portion) 102, a side plate (or portion) 104 and a mounting rail 106. Moreover, as illustrated, the support plate 102 has a plurality of mounting apertures 108 extending there through. The plurality of mounting apertures 108, provide a plurality of options in mounting a device to the device mount 100. This is further described in relation to FIG. 4.

Figure 4:
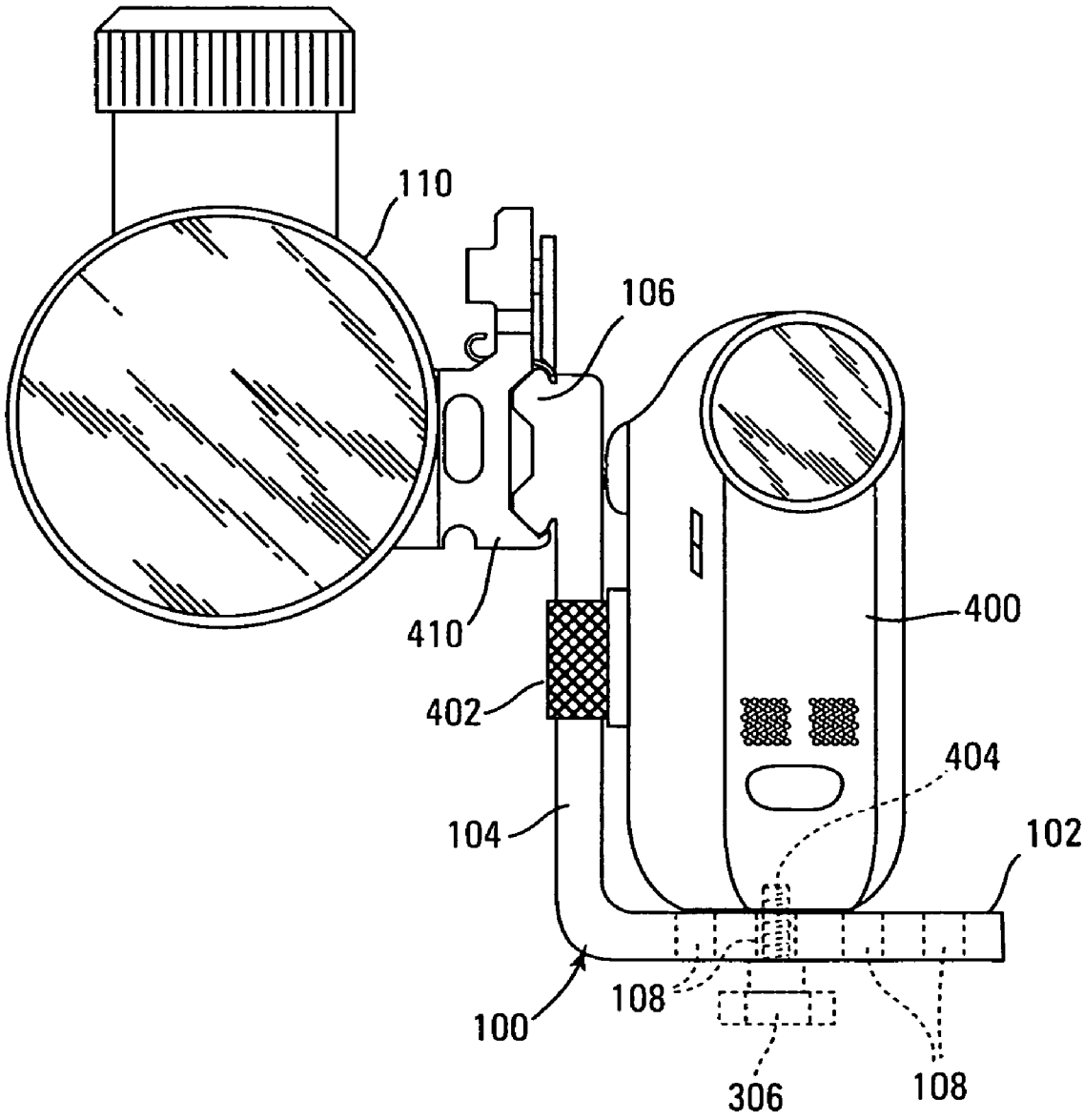
FIG. 4 is a front view of the device mount of FIG. 1 coupled to a scope and having a device mounted thereon.

FIG. 4 is a front view of the device mount 4 attached to a scope 110 and having a device 400 mounted thereon. In particular, the device is mounted to the support plate 106 via one of the plurality of mounting apertures 108. Having multiple mounting apertures 108 throughout the support plate 106 allows for use of different types and different models of devices to be mounted to the support plate 106 in a preferred position. A device 400 is mounted to the support plate 106 by first aligning one of the mounting apertures 108 in the support plate 106 with an internally threaded bore 404 in the device 400 while the device 400 is in the preferred position. An externally threaded attaching device such as a thumb screw 306 is then passed through the selected mounting aperture 108 and threadably engaged with the internal threads of the bore 404 in the device 400 thereby coupling the device 400 to the device mount 100.

As illustrated in FIG. 4, the mounting rail 106 can be attached to a scope mount 410. In one embodiment, the scope mount is a commercially available scope mount ring 410. The scope mount ring 410 is then in turn mounted to a scope 110 or some other cylindrical structure such as a barrel of a firearm (in which case 110 can be considered the barrel). Further illustrated in FIG. 4 is a strap 402 that is used to secure the device 400 around the side wall 104 of the device mount 100. In one embodiment, the strap 402 is a hand strap 402 that is commonly used with video cameras.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

The invention claimed is:

1. A device mount for a weapon having a scope, the device mount comprising:

a horizontal support portion adapted to support a device alongside the scope of the weapon, the support portion including a plurality of mounting apertures; and a vertical side portion coupled to the support portion, wherein the vertical side portion and the horizontal support portion form an L-shaped mounting bracket;

a mounting rail integral with the vertical side portion and extending parallel to a top surface of the horizontal support portion and parallel to a side surface of the vertical side portion, the mounting rail for attaching the L-shaped bracket alongside the scope of the weapon; and a scope mount ring for engaging the mounting rail to connect the L-shaped bracket to the scope.

2. The device mount of claim 1, wherein the vertical side portion further includes a lower end that is generally coupled to and continuous with the horizontal support portion and an upper end, the mounting rail having a top rail located at, and parallel to, the upper end of the vertical side portion.

3. The device mount of claim 1, wherein each mounting aperture is adapted to allow a thumb screw to engage the device to the support portion.

4. A mount for a device, the mount comprising:

a vertical side plate having an upper end and a lower end;

a horizontal support plate extending from the lower end of the side plate such that the vertical side plate and the horizontal support plate form an L-shaped bracket, the support plate adapted to support a device resting thereon, the support plate having a plurality of mounting apertures passing there through; and a mounting rail coupled to the vertical side plate, the mounting rail having a top rail located at an upper end of the vertical side plate and extending parallel thereto, and a bottom rail located below and parallel to the top rail, the mounting rail for attaching the L-shaped bracket alongside a scope of a weapon, wherein the mounting rail is adapted to be releasably engaged by a scope mount ring.

5. The mount of claim 4, wherein the device is one of a video camera, rangefinder and game caller.

6. A mounting system for a weapon having a scope mounted thereon, the system comprising:

a device mount having a support plate adapted to support a device resting thereon and a side plate extending upwardly from one side of the support plate such that the support plate and the side plate form an L-shaped bracket, the support plate having at least one mounting aperture, the device mount further having mounting rail; and a scope mount ring for surrounding the scope mounted on the weapon, the scope mount ring having a clamp for engaging the mounting rail thereby attaching the device mount alongside the scope mounted on the weapon.

7. The system of claim 6, further comprising: a thumb screw adapted to pass through the at least one mounting aperture and engage internal threads in a bore in the device.

8. The system of claim 6, wherein the support plate supports the device so that an eyepiece of the device is positioned at approximately a same height as an eyepiece of the scope when the device is mounted on the horizontal support plate and the scope ring clamps the L-shaped mounting bracket to the scope.

9. A method of attaching a device to a scope of a weapon, the method comprising:

positioning the device on a support plate of a device mount;

aligning an internally threaded bore in the device with one of a plurality of mounting apertures passing through the support plate;

threadably engaging the internally threaded bore through the one mounting aperture;

coupling a mounting rail on a side plate of the device mount to a scope mount ring; and coupling the scope mount ring to the scope of the weapon such that the side plate extends downwardly from the mounting rail and the support plate carrying the device is located alongside the scope.

10. The method of claim 9, wherein coupling the device mount to the scope mount ring further comprises: clamping the scope mount ring to the mounting rail on the device mount.

11. The method of claim 9, wherein threadably engaging the internally threaded bore through the one mounting aperture includes: passing a thumb screw having an externally threaded portion through the one mounting aperture.

12. The method of claim 9, wherein coupling the scope mount to the weapon further comprises: securing the scope mount ring around the scope of the weapon.

13. The method of claim 9, wherein coupling the scope mount ring to the scope of the weapon further comprises: coupling the scope mount ring to a barrel of the weapon.

* * * * *

UNITED STATES PATENT AND TRADEMARK OFFICE

CERTIFICATE OF CORRECTION

PATENT NO. : 7,661,221 B2
APPLICATION NO. : 11/480029
DATED : February 16, 2010
INVENTOR(S) : Larry Holmberg It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 589 days.

Signed and Sealed this

Thirtieth Day of November, 2010

David J. Kappos

David J. Kappos
*Director of the United States Patent and Trademark Office*